US007828610B2

(12) United States Patent
Lehmann et al.

(10) Patent No.: US 7,828,610 B2
(45) Date of Patent: Nov. 9, 2010

(54) CONNECTOR FOR USE WITH LIGHT-WEIGHT METAL CONDUCTORS

(75) Inventors: Lutz Lehmann, Vilsbiburg (DE); Klaus Kallee, Vilsbiburg (DE)

(73) Assignee: Lisa Draexlmaier GmbH, Vilsbiburg (DE)

( * ) Notice: Subject to any disclaimer, the term of this patent is extended or adjusted under 35 U.S.C. 154(b) by 0 days.

(21) Appl. No.: 12/496,022

(22) Filed: Jul. 1, 2009

(65) Prior Publication Data

US 2010/0003867 A1 Jan. 7, 2010

(51) Int. Cl.
*H01R 4/02* (2006.01)

(52) U.S. Cl. ..... 439/874; 29/860

(58) Field of Classification Search ..... 439/874; 29/860

See application file for complete search history.

(56) References Cited

U.S. PATENT DOCUMENTS

| | | | | | |
|---|---|---|---|---|---|
| 2,385,792 | A | * | 10/1945 | Carlson | 439/868 |
| 2,405,111 | A | * | 8/1946 | Carlson et al. | 439/868 |
| 2,513,365 | A | * | 7/1950 | Rogoff | 439/874 |
| 2,655,641 | A | * | 10/1953 | Asaff | 439/874 |
| 2,769,965 | A | * | 11/1956 | Frey | 439/730 |
| 2,806,215 | A | * | 9/1957 | Redslob | 439/868 |
| 2,815,497 | A | * | 12/1957 | Redslob | 439/203 |
| 3,656,092 | A | * | 4/1972 | Swengel et al. | 439/730 |
| 3,664,012 | A | * | 5/1972 | Wilke et al. | 29/597 |
| 3,842,487 | A | * | 10/1974 | Hartz | 228/116 |
| 3,876,280 | A | * | 4/1975 | Jones et al. | 439/750 |
| 3,949,466 | A | * | 4/1976 | O'Brien et al. | 29/861 |
| 3,955,044 | A | * | 5/1976 | Hoffman et al. | 174/84 C |
| 4,039,244 | A | * | 8/1977 | Leachy | 439/887 |
| 4,098,449 | A | * | 7/1978 | Noesen | 228/115 |
| 4,621,760 | A | * | 11/1986 | King et al. | 228/114.5 |
| 5,749,756 | A | * | 5/1998 | Vockroth et al. | 439/879 |
| 6,538,203 | B1 | * | 3/2003 | Nolle et al. | 174/84 R |
| 7,374,466 | B2 | * | 5/2008 | Onuma et al. | 439/874 |
| 2009/0229880 | A1 | * | 9/2009 | Watanabe | 174/72 A |
| 2010/0003867 | A1 | * | 1/2010 | Lehmann et al. | 439/874 |
| 2010/0096185 | A1 | * | 4/2010 | Otsuka et al. | 174/94 R |

FOREIGN PATENT DOCUMENTS

| | | | |
|---|---|---|---|
| DE | 102 23 397 | A1 | 12/2003 |
| DE | 10346 160 | B3 | 7/2005 |
| DE | 102005030248 | B3 | 8/2006 |
| EP | 0 018 863 | A | 11/1980 |

* cited by examiner

*Primary Examiner*—Ross N Gushi
(74) *Attorney, Agent, or Firm*—Wolf, Greenfield & Sacks, P.C.

(57) ABSTRACT

Connecting elements and methods for the electrical connection between a light-weight metal conductor and an electrical contact, in particular for use in motor vehicles are disclosed. A metal sleeve is cold welded to the conductor. A contact element is connected to the metal sleeve in an electrically conductive manner and can be connected to the contact. A hardenable liquid seals, in a gas-tight manner, a contact element-side opening in the metal sleeve cold welded to the light-weight metal conductor.

21 Claims, 5 Drawing Sheets

CONNECTOR FOR USE WITH LIGHT-WEIGHT METAL CONDUCTORS

CROSS REFERENCE TO RELATED APPLICATIONS

Foreign priority benefits are claimed under 35 U.S.C. §119 (a)-(d) or 35 U.S.C. §365(b) to German Application No. 10 2008 031 588.5, filed Jul. 3, 2008 which is hereby incorporated by reference in its entirety.

BACKGROUND

1. Field

Aspects relate to connectors for light-weight metal conductors, such as single or multiple stranded conductors, for example, aluminium conductors, which supply motor vehicle electrical consumers with electrical energy. Light-weight metal conductors of this type are also used for grounding electrical systems. Aspects also relate to method(s) for manufacturing a connecting element.

2. Discussion of Related Art

In motor vehicles, it has for a relatively long time been desirable, in order to save weight and also to substitute expensive metals with more economical alternatives, to make electrical conductors of light-weight metal, such as for example magnesium or aluminium or alloys thereof. Connections to these light-weight metal conductors present challenges, however. For example, in motor vehicles, dynamic loads over a long period of time (e.g. several years) and the tendency of the material to cold flow (even at low temperatures) reduces mechanical contacting forces in the connector, resulting in a poor electrical connection. An oxide layer, which can be present in particular on the surfaces of aluminium alloys, can also reduce the electrical conducting capacity through to the connector. Electrochemical corrosion in the region or interface between the connector and conducting wire can also reduce electrical conductivity. In this regard, connectors are conventionally made of nobler metals such as for example copper, and in the presence of electrolytes, maintaining an adequate connection is problematic. There has thus long been the need to provide improved connection to light-weight metal conductors.

U.S. Pat. No. 3,656,092 describes an aluminium line onto which an aluminium sleeve having a stepped internal diameter is placed in such a way that the end of the aluminium line abuts the steps within the aluminium sleeve. A copper contact element, having at its side facing the wire a sleeve having a complementary internal diameter, is slipped onto this aluminium sleeve. The aluminium sleeve and copper contact element are then connected by welding the two components.

U.S. Pat. No. 3,955,044 describes a connection element in which an aluminium line is connected to a copper contact element by slipping the contact element on the aluminium line and crimping the contact element to the aluminium line. During crimping, cold welding between the copper material of the contact element and the aluminium line occurs, at least in the region of the greatest deformation. The oxide layer present on the outside of the aluminium line is displaced during crimping.

U.S. Pat. No. 2,806,215 describes the electrical connection of an aluminium line to a copper contact element. An aluminium sleeve having a stepped internal diameter is slid onto the end of the aluminium line and subsequently welded to a complementarily shaped copper sleeve ending in a metal contact tab.

Cold welding of aluminium wires to copper sleeves slid onto the end of the wire is also described, by way of example, in DE 19 908 031 A1 and also DE 29 903 301 U1.

However, a common issue with all of these prior proposals is that they are unable to ensure a permanent electrical connection under dynamic loads and in the presence of electrolytes at the interface with the electrical connecting element. None of the prior proposals is able to counteract the above-mentioned problems that can cause the electrical connection fail under dynamic loads and in an environment generally supporting corrosion.

SUMMARY

In one illustrative embodiment, a connecting element for the electrical connection between a light-weight metal conductor and an electrical contact, for use in motor vehicles, is provided. The connecting element includes a metal sleeve cold welded to the light-weight metal conductor and a contact element connected to the metal sleeve in an electrically conductive manner and can be connected to a contact of an electrical consumer. A gas-tight hardenable liquid seal is disposed in a contact element-side opening in the metal sleeve cold welded to the light-weight metal conductor.

In another embodiment, a method for manufacturing a connecting element for the electrical connection between a light-weight metal conductor and an electrical contact, for use in motor vehicles, is disclosed. The method includes cold welding a metal sleeve to the light-weight metal conductor, connecting the metal sleeve to a contact element, wherein the contact element can in turn be connected to the contact, and gas-tight sealing a contact element-side opening in the cold welded metal sleeve with a hardenable liquid.

In another embodiment, an electrical connector and conductor combination for use in motor vehicles is disclosed. The combination includes a light-weight metal conductor a metal sleeve having a first end ultrasonically cold welded to the light-weight metal conductor and second end opposite the first end, with the second end having an opening. A contact element is electrically connected to the second end of the metal sleeve. The contact element is adapted to be connected to a contact of an electrical consumer. A gas-tight hardenable liquid seal is disposed in the opening in the second end of the metal sleeve.

Various embodiments of the present invention provide certain advantages. Not all embodiments of the invention share the same advantages and those that do may not share them under all circumstances.

Further features and advantages of the present invention, as well as the structure of various embodiments of the present invention are described in detail below with reference to the accompanying drawings.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. Various embodiments of the invention will now be described, by way of example, with reference to the accompanying drawings, in which.

DETAILED DESCRIPTION

Figure 1:
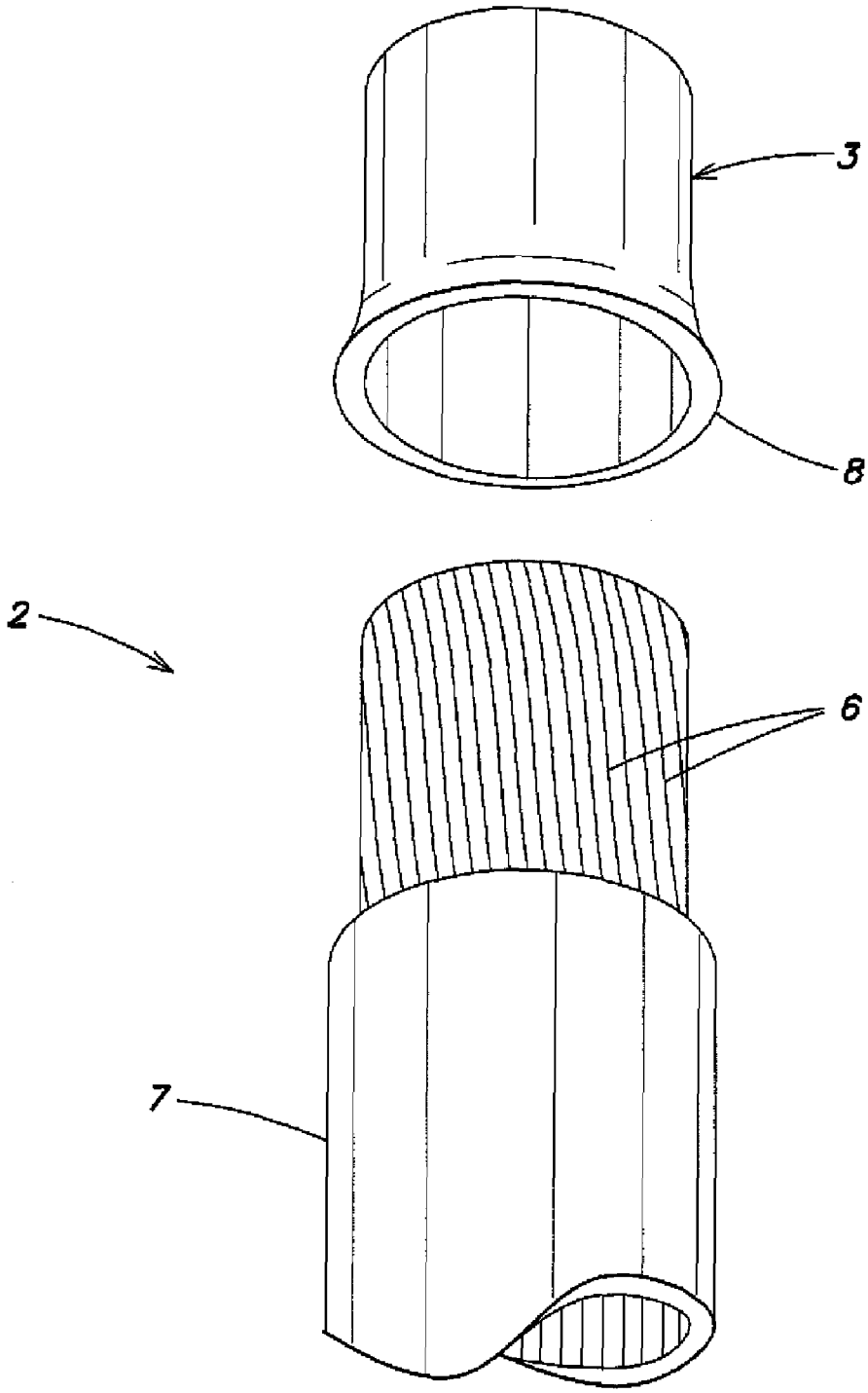
FIG. 1 is a perspective illustration of a light-weight metal conductor and a metal sleeve.

A connecting element for the electrical connection between a light-weight metal conductor (also referred to, e.g., as a "wire" or "electrical wire" or "conducting wire" or "line") and an electrical contact, for example, for use in motor vehicles, is provided. The connection provides the contacting of the light-weight metal conductor at least in a force-transmitting and form-fitting manner and also with effective corrosion protection. To achieve these and other attributes, the connecting element and method of producing the connecting element includes various features, each of which will be described in greater detail below. It should be appreciated that various combinations of the described features of the connecting element and the method of manufacture can be employed together; however the invention is not limited in this respect. Therefore, although the specific embodiments disclosed in the figures and described in detail below employ particular combinations of the described features of the connecting element and the method of manufacture, it should be appreciated that the present invention is not limited in this respect, as the various aspects of the present invention can be employed separately, or in different combinations. Thus, the particular embodiments of the connecting element and the method of manufacture described herein in detail are provided for illustrative purposes only.

The connecting element provides effective corrosion protection of an electrical connection to light-weight metal conductors, in particular an aluminium wire having one or more strands, to a contact element on the basis of cold welding (also referred to here as friction welding) of the conductor to a metal sleeve and connecting the metal sleeve to a contact element. In this case, the electrical connection between the conducting wire and the contact is produced indirectly via cold welding of a metal sleeve to the wire and subsequently connecting to a contact element. In one embodiment, a copper sleeve, which has low hardness (for example soft annealed electrical grade copper) and is thin-walled compared to the contact element, is positioned over the end of the light-weight metal wire. The copper sleeve and wire are subsequently pressed together and at the same time at least partially cold welded together.

Cold welding can be performed using any suitable device, as the invention is not limited in this respect. In one embodiment, ultrasonic welding of the sleeve and the wire may be employed. In the case of aluminium wires, any oxide layer present on the surface of the aluminium is removed or abraded away due to the reciprocating motion of the sleeve relative to the wire during the ultrasonic welding. In addition, an electrical connection between the individual strands of a multi-strand wire can be attained. In one embodiment, the welding space of the installation is set in such a way that the external dimension (e.g., outer diameter) of the resulting sleeve/wire combination corresponds to the internal dimensions (e.g., inner diameter) of a connecting lug of the contact element. The sleeve/wire combination is positioned on the connecting lug of the contact element and connected thereto, in one embodiment, by way of cold welding.

In one embodiment, the connection between the metal sleeve and contact element is produced via cold welding. In one embodiment, the connection may be made in addition or in the alternative via the application of an electrically conductive and hardenable liquid. In one embodiment, the hardenable liquid is a thermally hardenable liquid, such as for example an adhesive or a solder. In one embodiment, the solder employed is a lead-free, tin-based solder. A form-fitting and force-transmitting, and also material-uniting connection can be attained as a result.

In one embodiment, the cross-sectional surface area of a contact element-side opening between the metal sleeve and the conductor is reduced to a minimum during the cold-welding process. Similarly, the cross-sectional surface area between the metal sleeve and the contact element is also reduced to a minimum during the cold-welding process. In one embodiment, this interface is sealed, for example, by a hardenable liquid. In one embodiment, the sealing results in a gas-tight seal. Such closeness in the cross-sectional areas and/or the use of the sealant ensures the required corrosion resistance of the connecting element as a whole. In a one embodiment, the strength of the connection between the metal sleeve and contact element is at least increased by the hardenable liquid.

The mechanical strength of the connection of the light-weight metal conductor, the metal sleeve and contact element is accomplished through the cold welding process, resulting at least in a force-transmitting and form-fitting connection between the surfaces. In this regard, in a cold welding process, the contacting components rub against one another. In addition, a form-fitting and force-transmitting connection may occur between the strands of a multi-strand conductor. In this regard, relative movement between the individual strands during the cold-welding process results in the form-fitting and force-transmitting relation among the strands.

It should be noted that a material-uniting connection is conventionally not observed when aluminium and copper are cold-welded; on the contrary, the cold welding results from indenting and engaging of the mutually opposing surfaces. However, a material-uniting connection is also advantageous, at least in partial regions, and is accordingly regarded as being included by the invention.

Without being limited to theory, a material-uniting connection of this type may be provided by the adhesion of the mating components as a consequence of wearing down of the surface unevenness. In addition, the form-fitting connection may be produced also by undercutting of the light-weight metal conductor and in particular of stranded wires with folds within the sleeve. These folds are present as a consequence of the upsetting of the metal sleeve during the cold welding process.

Again without being limited to theory, a form-fitting connection may be produced based on the peeling stress resulting from the supporting effect of the sleeve. Such an effect is not to be expected during direct cold welding of a light-weight metal conductor to a contact element. Finally, an optimum form-fitting and material-uniting fit of the connection is produced by mutually adapted geometries of the metal sleeve and connecting lug on the contact element itself.

Again without being limited to theory, connections between metals may become loose due to cold flowing of the metals. For instance, cold flow in light-weight metals may be caused by the grains in the metals slipping past each other and also due to the migration of offsets and the frequent cancelling of offsets. This flow process can even occur at room temperature. The result of such cold flow is that the mechanical stress within the structure is reduced, resulting in the overall reduction of mechanical strength of the connection.

In cold welding, such as for example ultrasonic welding and as is used in embodiments described herein, the mating components are stressed by frictional energy up to the plastic state, as a result of which the stress produced during compressing is substantially reduced. In addition, in one embodiment, cold welding (at least in the connection of the sleeve to the contact element) is followed by application of an electrically conductive and hardenable liquid, for example a solder, as a result of which heat is preferably introduced into the material. This introduction of heat introduces into the material the energy required for the migration of offsets. This may lead to the reduction of residual stresses still present in the material. As a result, during preparation of the connection, almost no residual stresses are introduced or remain and accordingly cold flowing is almost completely eliminated during use of the connecting element. Though in one embodiment, solder may be used whereby heat is introduced to melt the solder to flow, with the heat aiding in reducing the above-mentioned residual stresses, other heat generating or heat curable hardenable liquids, such as epoxies, may be employed. In one embodiment, application of heat to melt the solder to its melting point of between 220° C. and 230° C. aids in reducing the residual stress. Other temperatures may be employed, as the present invention is not limited in this regard.

In addition, the connecting element according to one embodiment is intended to provide protection from corrosion, and in one embodiment from electrochemical corrosion. This protection can be especially important in particular at two points of the connecting element, namely at the front or contact element-side end of the welded conductor and also at the conductor-side end of the metal sleeve, where the light-weight metal conductor enters.

At the front or terminal end of the connection, it may not be readily possible to protect the exposed light-weight metal wires from corrosion using a coating, for example tin, as the oxide layer present on the wire surface prevents complete wetting with the conductive liquid. In order to solve this problem, the metal sleeve is in one embodiment covered by a hardenable liquid at the side facing the contact element. In one embodiment, the metal sleeve is soldered. In one embodiment, the covering is formed in a gas-tight manner.

In one embodiment, the dimensions of the metal sleeve are set in such a way that the metal sleeve protrudes, once slipped onto the conventionally stripped end of the light-weight metal conductor, beyond the end of the conductor, so that after the cold welding process this leading end of the metal sleeve is pressed or collapsed. In one embodiment, this leading end of the sleeve is pressed such that the underside of the metal sleeve becomes flat (i.e., having a planar surface). This surface assist with the connection of the sleeve to the contact element, which can be a flat contact lug or connecting lug.

In one embodiment, the leading edge of the compressed metal sleeve is configured in such a way that it is almost gap-free, thus aiding with a gas-tight sleeve after the application of the hardenable liquid. During application of the liquid, the liquid covers and seals in a gas-tight manner, any residual gap remaining in the sleeve. In one embodiment, the gas-tight hardenable liquid seal disposed terminal end of the connection is also disposed to electrically connect the contact element to the metal sleeve. In one embodiment, a non-corrosive, halogen-free fluxing agent is employed during the soldering of the metal sleeve and contact element, though other agents or no agents at all may be employed.

Another second location which may be necessary to protect against corrosion is the conductor-side end of the metal sleeve, where the light-weight metal conductor enters. In one embodiment, the gap, which may remain between the cut edge of the insulation after the insulation is striped from the conductor and the conductor-side end of the metal sleeve, is protected from the infiltration of corrosive and electrically conductive media (electrolytes).

In one embodiment, an adhesive shrink tube may be employed. In one embodiment, a sheathing or marking may be used, wherein the capillary effect of the wires can be utilised, such as when using highly viscous paints. In one embodiment, this region of the connection may be immersed or wound around with a material having insulating properties.

In one embodiment, the use of an adhesive shrink tube may be utilized and may be advantageous, because such a tube can bring about stress relief (e.g., torsional stress relief) of the welding point, which may otherwise be weakened as a result of the compression with the metal sleeve relative to the residual material of the light-weight metal conductor. As a result, an almost complete water-tight system of the connecting element and insulated light-weight metal wire can be attained.

An aspect of the invention provides a connecting element for electrical connection between a light-weight metal conductor and an electrical contact.

Light-weight metal conductors are conventionally made of aluminium, but in a few cases can be made of magnesium or a magnesium-based alloy instead. In one embodiment, the light-weight metal conductor is an aluminium wire which in one embodiment is an aluminium stranded conductor having a plurality of strands. In stranded wire, the individual strands are conventionally wound parallel to one another and helically around a nucleus. Cold welding the metal sleeve to a light-weight aluminium stranded conductor results in a secure connection with particularly good success.

The metal sleeve can be made of any material which can be connected to a light-weight metal via cold welding. In one embodiment, the metal sleeve is made of copper, and in one embodiment is formed from electrolytic copper. In one embodiment, the metal sleeve is formed of a soft annealed electrolytic copper. In this case, a particularly good cold welding result can be attained, in particular in conjunction with an aluminium conductor. In addition, it should also be noted that no corrosion of aluminium, which is much less noble than copper, is to be expected at least when electrically conductive media, known as electrolytes, cannot infiltrate the region of contact of both metals.

Once the light-weight metal conductor has been cold welded to the metal sleeve, the metal sleeve is then connected to the contact element, for example via cold welding and/or via an electrically conductive and hardenable liquid. The shape of the metal sleeve may be adapted to the shape of the contact element. If cold welding is employed, in one embodiment, cold welding may only occur in a partial length of the metal sleeve and accordingly a proportion of the metal sleeve protrudes beyond the end of the conductor. Reshaping of the sleeve can be carried out almost in any desired manner.

In one embodiment, the light-weight metal conductor is connected to the metal sleeve and the metal sleeve is connected to the contact element, in one operation, for example, by cold welding. This provides a connection between the contact element and metal sleeve that is particularly dimensionally stable and assists the connecting process particularly advantageously. In one embodiment, after application of the hardenable liquid, a completely gas-tight connection can be produced between the contact element and metal sleeve. In one embodiment, application of the hardenable liquid can be accomplished using any suitable arrangement, such as employing commercially available controllable devices.

In one embodiment, the shape of the mating components (e.g., metal sleeve and conductor or metal sleeve and contact element) and in particular by a mutually adapted shape of the mating surfaces of the components assists with a suitable cold weld. Thus, the cold welding, in particular the ultrasonic cold welding, is advantageously assisted if the mating faces are configured so as to be substantially complementary to one another. This also facilitates the placing of the metal sleeve onto the sleeve-side end of the light-weight metal conductor. Also, centering of the conductor within the metal sleeve, or placing a crimped, contact element-side end of the metal sleeve (which may have been cold welded to the light-weight metal conductor), onto the connecting lug of the contact element.

In one embodiment, at least partial regions of the metal sleeve are reshaped into the cross section of the light-weight metal conductor during the cold welding process. In one embodiment, the internal diameter of the metal sleeve is larger than the external diameter of the stripped light metal line. In one embodiment, the internal diameter is between 5% and 30% larger than the external diameter of the conductor. In one embodiment, the internal diameter is between 10% and 20% larger than the external diameter of the conductor.

In one embodiment, sufficient material of the metal sleeve is present, such that the metal sleeve can be reshaped into the cross section of the light-weight metal conductor during the cold welding process without altering the wall thickness of the metal sleeve. In one embodiment, no cracks or sharp edges occur within the reshaped metal sleeve. This allows, in one embodiment, a particularly secure and enduring force-transmitting and form-fitting connection to be obtained between the metal sleeve and light-weight metal conductor. In addition, such reshaping of the metal sleeve into the cross section of the light metal line also increases the area of contact between both mating components, thus improving the electrical connection.

A method for manufacturing a connecting element for the electrical connection between a light-weight metal conductor and an electrical contact is provided. In one embodiment, in a first step, a metal sleeve is cold welded to the light-weight metal conductor and, in a subsequent step, the metal sleeve is connected to a contact element. The contact element allows connection to an electrical consumer of a motor vehicle, allowing power and or a signal between the conductor and the electrical consumer to be established. In one embodiment, the metal sleeve and contact element are connected, for example, via cold welding and/or by the application and also the hardening of an electrically conductive liquid, for example an adhesive or solder. In any case, however, a hardenable liquid is used to seal, preferably in a gas-tight manner, a contact element-side opening in the metal sleeve, which is cold welded to the light-weight metal conductor and/or the contact element.

In one embodiment, this method serves to manufacture the electrical connection described herein.

In one embodiment, the metal sleeve is cold welded (such as by ultrasonic welding) to the light-weight metal conductor, such as an aluminium conductor having one or more strands. Without being limited to theory, cold welding of predominantly metallic workpieces provides a connection of the mating components that are at room temperature. This connection comes very close to the material-uniting connection, established by normal welding, of the mating components. In the case of such friction welding, the mating components touching at the contact faces are moved relative to each other. The resulting friction leads to heating of the mating components, albeit to a temperature well below the liquidus temperature of the joining partners.

In one embodiment, ultrasonic welding is suitable, in particular, for aluminium materials. Oxide layers, which are present on the surface of the aluminium grains, spread over a large area and an intimate connection of the mating components is thus attained. During ultrasonic welding, high-frequency mechanical oscillation is introduced into at least one mating components and the heat, which is required for welding, between the these joining partners is produced in the components as a result of molecular and interfacial friction.

Any suitable ultrasonic welding apparatus may be employed. In one embodiment, the ultrasonic welding apparatus includes following modules: generator, sonotrode and anvil. The ultrasonic frequency is generated with the aid of a high-frequency generator, these frequencies being converted via an ultrasonic transducer into mechanical oscillations which are transmitted to the sonotrode. However, ultrasonic welding of, in particular, aluminium does not lead to plasticising or melting of one or both surfaces of the mating components. On the contrary, the connection is, as described at the outset, produced, after breaking-open of the oxide layer, substantially by meshing of the respective joining partners.

In one embodiment, the method can introduce the reshaping required for the cold welding into the mating components in a highly reproducible manner and without significant wear to the tools. In addition, the metal sleeve is cold welded to the light-weight metal conductor for a period of between 0.5 and 1 second, although other time periods may be employed as the invention is not limited in this regard. In one embodiment, the method may be employed on a large industrial scale.

As previously mentioned, the cold welding is, in one embodiment, is carried out in such a way that at least parts of the metal sleeve are reshaped into the cross section of the light-weight metal conductor. This may be carried out, for example, by appropriate dimensional configuration of the ultrasonic welding tools, in particular the anvil. This allows a highly reproducible cold welding result to be attained using a particularly simple arrangement. In addition, increased electrical contact area and the mechanical connection of the mating components can easily and reliably be attained.

As shown in the figures, in one embodiment, a connecting element 1 for the electrical connection between a light-weight metal conductor 2 and an electrical contact, in particular for use in motor vehicles, is provided. The connecting element 1 includes a metal sleeve 3 which is cold welded to the light-weight metal conductor 2 and also a contact element 4 which is connected to the metal sleeve 3 in an electrically conductive manner via a hardened liquid and can in turn be connected to the contact. In one embodiment, the light-weight metal conductor 2 is an aluminium wire, and in one embodiment, is an aluminium stranded wire. In one embodiment, the metal sleeve 3 is a copper sleeve, and in one embodiment, the copper sleeve is made of electrolytic copper. In one embodiment, the contact element 4 is soldered, preferably in a gas-tight manner, to the metal sleeve 3. In one embodiment, the contact element 4 is connected, preferably in a gas-tight manner, to the metal sleeve 3 with an electrically conductive and cured adhesive. In one embodiment, the cold welded connection of the metal sleeve 3 and light-weight metal conductor 2 is present in a partial length of the metal sleeve 3. In one embodiment, the shape of the metal sleeve 3 cold welded to the light-weight metal conductor 2 is adapted to the shape of the contact element 4. In one embodiment, partial regions of the metal sleeve 3 cold welded to the light-weight metal conductor 2 are reshaped into the cross section of the light-weight metal conductor 2. In one embodiment, a region of transition of the light-weight metal conductor 2 and metal sleeve 3 is electrically insulated from the environment. In one embodiment, the electrical insulation is formed as a plastic material coating, preferably a plastic material tube placed and shrunk onto the region of transition. In one embodiment, the electrical insulation is a sheathing or painting of the region of transition.

In one embodiment, a method for manufacturing a connecting element 1 for the electrical connection between a light-weight metal conductor 2 and an electrical contact, in particular for use in motor vehicles, is provided. The method includes cold welding a metal sleeve 3 to the light-weight metal conductor 2 and subsequently connecting the metal sleeve 3 to a contact element 4, via an electrically conductive, hardened liquid. The contact element 4 can in turn be connected to the contact. In one embodiment, the metal sleeve 3 is cold welded to the light-weight metal conductor 2 by an ultrasonic cold welding. In one embodiment, during the cold welding, at least parts of the metal sleeve 3 are cold welded into the cross section of the light-weight metal conductor 2. In one embodiment, the metal sleeve 3 and contact element 4 are connected by means of soldering. In one embodiment, the soldering between the metal sleeve 3 and contact element 4 is carried out in such a way that a gas-tight connection is created between the metal sleeve 3 and the contact element 4. In one embodiment, the solder seeps, during the soldering of the metal sleeve 3 and the contact element 4, into an opening 5 in the metal sleeve 3 that faces the contact element 4.

FIG. 1 shows a view of the sleeve-side end of an aluminium conductor 2. In this embodiment, the aluminium conductor 2 has a plurality of strands 6, which are arranged parallel to one another and wound helically around a nucleus. An insulation sheathing 7 is disposed about the strands. At the contact-side end of the light-weight metal conductor 2, this insulation sheathing 7 has been removed to allow this region of the light-weight metal conductor 2 to be cold welded to a metal sleeve 3. In this embodiment a light-weight metal sleeve 3 is made of soft annealed electrolytic copper. The internal diameter of the copper sleeve 3, is in this embodiment, configured so as to be slightly larger than the external diameter of the stripped end of the aluminium conductor 2. In addition, in one embodiment, at its line-side end, the copper sleeve 3 has a flared-end 8 in order to avoid a sharp-edge transition between the copper sleeve 3 (which is cold welded to the aluminium conductor 2) and the insulation sheathing 7.

Figure 2:
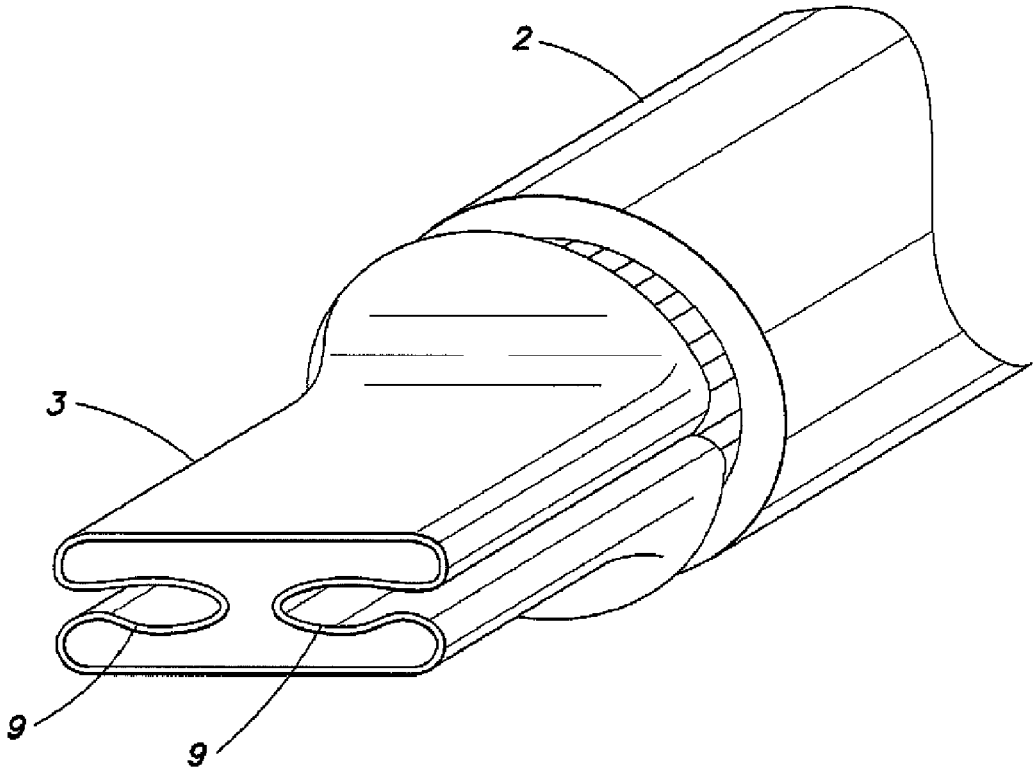
FIG. 2 is a perspective view of a metal sleeve, cold welded to the light-weight metal conductor.

In one embodiment, the outer diameter of the flared end 8 is approximately equal to the outer diameter of the insulation sheathing 7. FIG. 2 shows an embodiment of a copper sleeve 3 cold welded to the contact-side end of an aluminium conductor 2. In this embodiment, the cold welding has been carried out in such a way that the upper side and underside of the metal sleeve 3 are configured so as to be substantially flat. As shown, in the side regions, indentations 9 are formed into the cross section of the aluminium conductor 2. The geometrical shape of these indentations displays no sharp transitions or edges in order to avoid severing of individual strands (not shown) of the aluminium conductor within the reshaped copper sleeve 3. On the contrary, the indentations 9 are introduced during the cold welding process in such a way that the indentations 9 displace the strands (not shown) of the aluminium conductor so that they slide along the surfaces of the indentations 9. Thus, a particularly intimate and enduring composite of the aluminium conductor 2 and copper sleeve 3 is formed.

Figure 3:
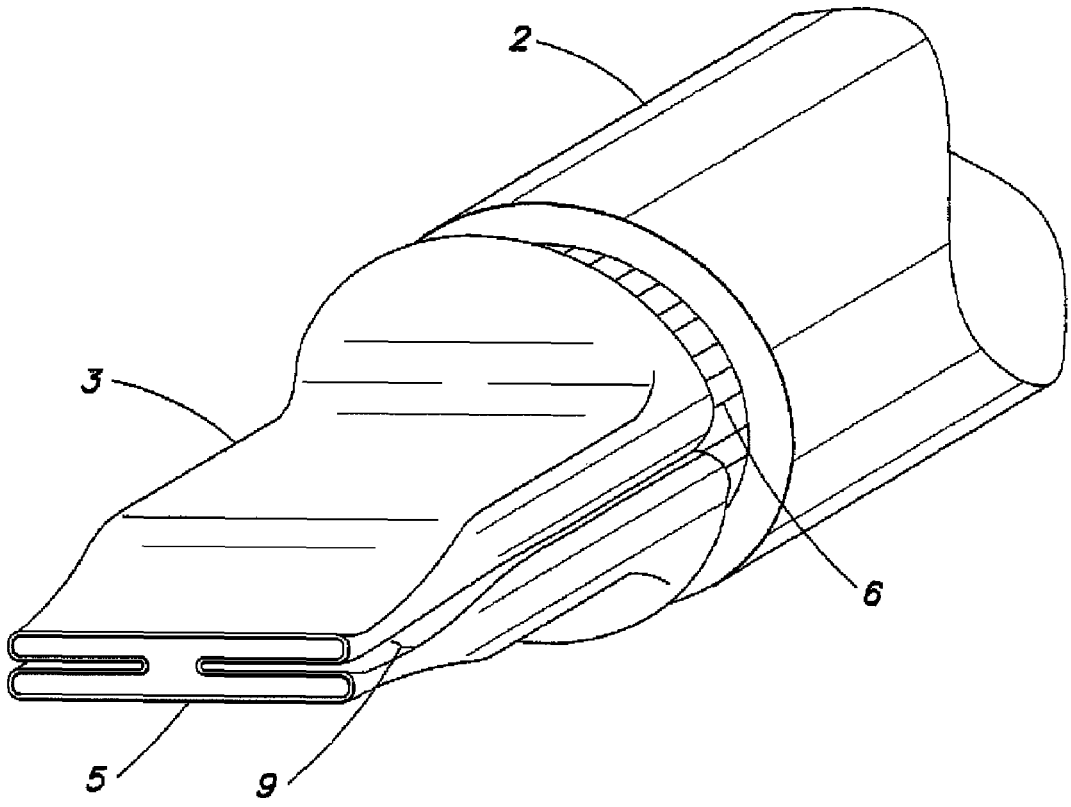
FIG. 3 is a perspective view of a metal sleeve, cold welded to a light-weight metal conductor.

FIG. 3 shows an embodiment of a copper sleeve 3 cold welded to an aluminium conductor 2. In this embodiment, indentations 9 are also introduced during the cold welding process into the side regions of the copper sleeve 3, which is deformed in a substantially flat manner. However, the dimensions of the copper sleeve 3 are configured in such a way that the bare strands 6 of the aluminium conductor 2 are received only in a partial length of the copper sleeve 3. The end of the copper sleeve 3 that is remote from the aluminium conductor 2 can be pressed together in a beak-like manner, so that all that is left is a narrow residual gap 5. In one embodiment, this configuration is substantially liquid and gas-tight.

Figure 4:
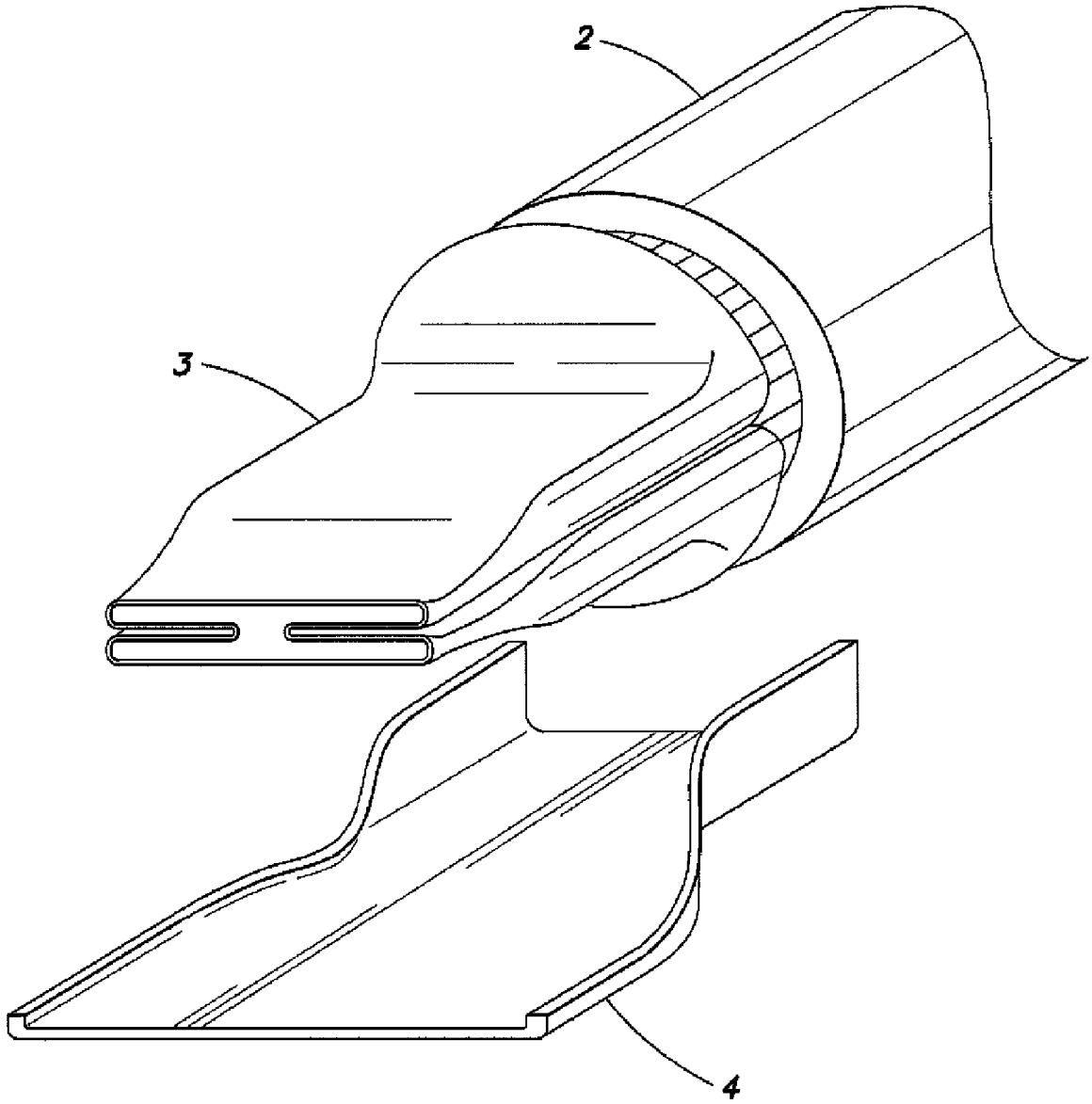
FIG. 4 is a perspective illustration of the cold welded light-weight metal conductor from FIG. 3 prior to connection to a contact element.

FIG. 4 shows an embodiment where the connection of the copper sleeve 3 and aluminium conductor 2 from FIG. 3 is arranged above a contact element 4. The outer shape of the reshaped metal sleeve 3 is adapted to the shape of the connecting region of the contact element 4 (connecting lug) in such a way that an angular offset of the metal sleeve 3 and contact element 4 can already readily be prevented. The electrical connection to the contact of an electrical consumer (not shown) is then produced via the end of the contact element 4 that is remote from the aluminium conductor 2.

Figure 5:
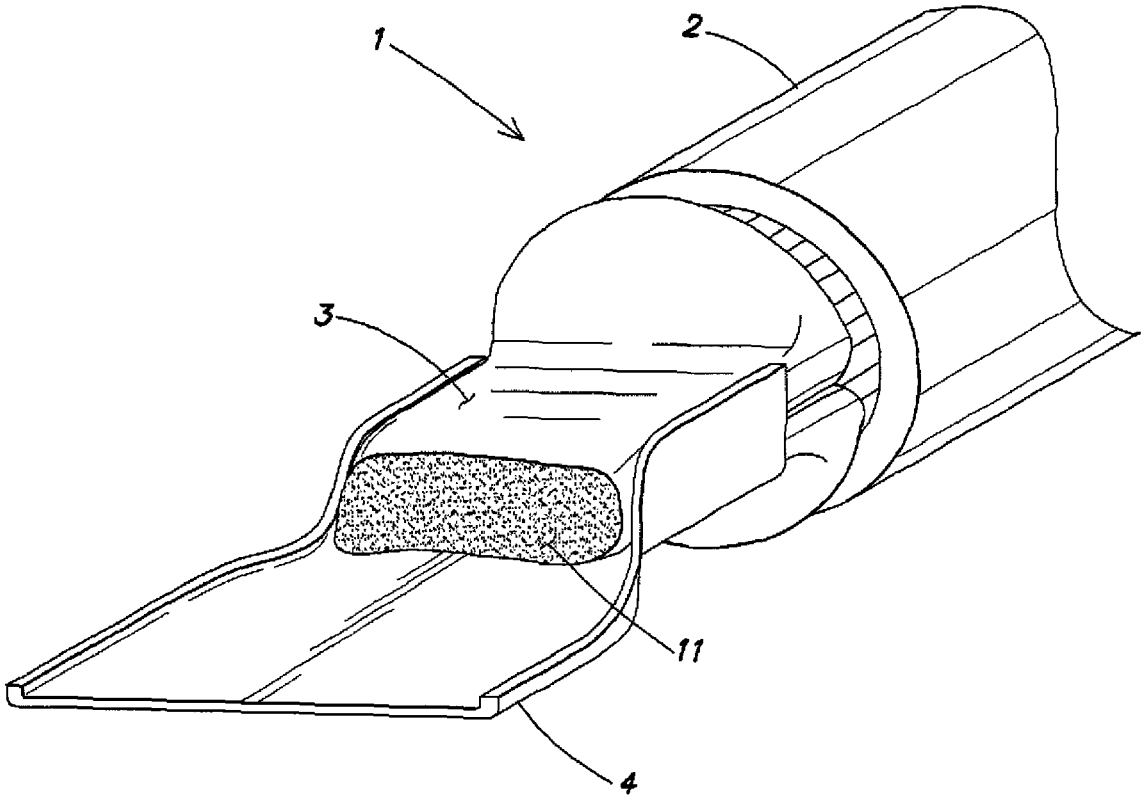
FIG. 5 shows an embodiment of a connecting element.

FIG. 5 shows a connecting element 1 according to an embodiment including the aluminium conductor 2, the copper sleeve 3 cold welded to the aluminium conductor 2 and a contact element 4 connected to the copper sleeve 3. In one embodiment, a hardenable liquid is applied to the end of the copper sleeve remote from the aluminium conductor 2. The hardenable liquid covers the schematically illustrated region 11 in such a way that the copper sleeve 3 surrounds the aluminium conductor 2 near the side of the contact element 4 in a gas-tight manner. In one embodiment, the hardenable liquid is applied after cold welding the metal sleeve 3 and the contact element 4.

Having thus described several aspects of at least one embodiment of this invention, it is to be appreciated various alterations, modifications, and improvements will readily occur to those skilled in the art. Such alterations, modification, and improvements are intended to be part of this disclosure, and are intended to be within the spirit and scope of the invention. Accordingly, the foregoing description and drawings are by way of example only.

What is claimed is:

1. A connecting element for the electrical connection between a light-weight metal conductor and an electrical contact, for use in motor vehicles, comprising:

a metal sleeve cold welded to the light-weight metal conductor;

a contact element is connected to the metal sleeve in an electrically conductive manner and can be connected to a contact of an electrical consumer; and a gas-tight hardenable liquid seal disposed in a contact element-side opening in the metal sleeve cold welded to the light-weight metal conductor.

2. The connecting element according to claim 1, wherein the contact element is soldered to the metal sleeve.

3. The connecting element according to claim 1, wherein the contact element is cold welded to the metal sleeve.

4. The connecting element according to claim 1, wherein a portion of the metal sleeve protrudes from the conductor, once slipped onto a stripped end of the conductor, and the contact element-side end of the metal sleeve is cold welded to the conductor, and wherein the portion of the metal sleeve protrudes from the conductor is substantially pressed.

5. The connecting element claim 1, wherein partial regions of the metal sleeve cold welded to the light-weight metal conductor are reshaped into the cross section of the light-weight metal conductor.

6. The connecting element claim 1, wherein a region of transition of the light-weight metal conductor and metal sleeve includes an electrical insulator to insulate the transition from the environment.

7. The connecting element claim 6, wherein the electrical insulator comprises plastics material tube placed and shrunk onto the region of transition.

8. The connecting element claim 6, wherein the electrical insulator comprises one of a sheathing or painting on the region of transition.

9. The connecting element according to claim 1, wherein the light-weight metal conductor is an aluminium conductor, and wherein the metal sleeve is a copper sleeve.

10. The connecting element according to claim 9, wherein the light-weight metal conductor is an aluminium stranded conductor, and wherein the metal sleeve is a copper sleeve made of electrolytic copper.

11. A method for manufacturing a connecting element for the electrical connection between a light-weight metal conductor and an electrical contact, for use in motor vehicles, the method comprises:

cold welding a metal sleeve to the light-weight metal conductor;

connecting the metal sleeve to a contact element, wherein the contact element can in turn be connected to the contact; and gas-tight sealing a contact element-side opening in the cold welded metal sleeve with a hardenable liquid.

12. The method according to claim 11, wherein cold welding a metal sleeve to the light-weight metal conductor comprises ultrasonic cold welding the metal sleeve to the light-weight metal conductor.

13. The method according to claim 11, wherein, during cold welding, at least parts of the metal sleeve are cold welded into the cross section of the light-weight metal conductor.

14. The method according to claim 11, wherein gas-tight sealing a contact element-side opening in the cold welded metal sleeve with a hardenable liquid comprises gas-tight sealing the contact element-side opening in the cold welded metal sleeve with solder.

15. The method according to claim 11, wherein gas-tight sealing a contact element-side opening in the cold welded metal sleeve with a hardenable liquid comprises gas-tight sealing the contact element-side opening in the cold welded metal sleeve with an electrically conductive adhesive.

16. The method according to claim 11, wherein the hardenable liquid seeps into a contact element-side opening in the metal sleeve.

17. The method according to claim 11, further comprising cold welding the metal sleeve to the contact element.

18. The method according to claim 17, wherein comprising cold welding the metal sleeve to the contact element comprises ultrasonic cold welding the metal sleeve to the contact element.

19. An electrical connector and conductor combination for use in motor vehicles, the combination comprising:

a light-weight metal conductor;

a metal sleeve having a first end ultrasonically cold welded to the light-weight metal conductor and second end opposite the first end, the second end having an opening;

a contact element electrically connected to the second end of the metal sleeve, the contact element adapted to be connected to a contact of an electrical consumer; and a gas-tight hardenable liquid seal disposed in the opening in the second end of the metal sleeve.

20. The electrical connector and conductor combination according to claim 19, wherein the light-weight metal conductor comprises an aluminium conductor and the metal sleeve is formed of electrolytic copper.

21. The electrical connector and conductor combination according to claim 19, wherein, the gas-tight hardenable liquid seal disposed in the opening in the second end of the metal sleeve is also disposed to electrically connect the contact element to the metal sleeve.

* * * * *